US005563560A

United States Patent [19]

Komatsu et al.

[11] Patent Number: 5,563,560

[45] Date of Patent: Oct. 8, 1996

[54] COUPLING CAPACITANCE DIELECTRIC BOARD FOR COAXIAL RESONATORS

[75] Inventors: Yuji Komatsu; Yoshiki Yamada, both of Ishikawa-ken, Japan

[73] Assignee: Murata Manufacturing Co., Ltd., Japan

[21] Appl. No.: 364,366

[22] Filed: Dec. 27, 1994

[30] Foreign Application Priority Data

Dec. 27, 1993 [JP] Japan ..... 5-352163

[51] Int. Cl.[6] ..... H01P 1/202

[52] U.S. Cl. ..... 333/206; 333/222

[58] Field of Search ..... 333/202, 206, 333/207, 222, 223, 203, 204, 205, 219

[56] References Cited

U.S. PATENT DOCUMENTS 5,081,435 1/1992 Yorita ..... 333/206
5,304,967 3/1994 Havashi ..... 333/206
5,374,910 12/1994 Yamagata ..... 333/206
5,379,012 1/1995 Shimizu et al. ..... 333/206

FOREIGN PATENT DOCUMENTS 5218704 8/1993 Japan ..... 333/202 DB

*Primary Examiner*—Benny Lee
*Assistant Examiner*—Justin P. Bettendorf
*Attorney, Agent, or Firm*—Majestic, Parsons, Siebert & Hsue

[57] ABSTRACT

A dielectric resonator apparatus has a main resonator part containing a plurality of resonance circuits, a coupling board with electrodes thereon individually connected to the resonance circuits for capacitively coupling them, and a dielectric board superposed on the coupling board for increasing the capacitive coupling of the resonance circuits by providing floating capacitance therethrough which are connected in parallel to the capacitance between the resonance circuits through the coupling board.

19 Claims, 5 Drawing Sheets

COUPLING CAPACITANCE DIELECTRIC BOARD FOR COAXIAL RESONATORS

BACKGROUND OF THE INVENTION

This invention relates to dielectric resonator apparatus functioning as a dielectric filter usable in a mobile communication device such as car telephones and portable telephones.

As an example of prior art dielectric resonator apparatus, FIG. 9 shows a three-stage bandpass filter having its main resonator part 1 formed with three ¼-wavelength type dielectric coaxial resonators 2–4. Each of these dielectric coaxial resonators 2–4 has an outer conductor 5 in the form of a film electrode covering each external surface of a dielectric block in the shape of a rectangular parallelopiped except one of its end surfaces functioning as an open surface. The other end surface, on which the outer conductor 5 is not formed, serves as a shorted surface. Each of the dielectric coaxial resonators 2–4 has a throughhole 6 penetrating therethrough at its central portion, and an inner conductor is formed in the form of another film electrode on the inner surface of each of the throughholes 6. An approximately cylindrical metallic connector 7 is pressed into the interior of each of the throughholes 6 so as to be in an electrically conductive relationship with the inner conductor therein. A grounding electrode 14 in the form of a film is formed at a frontal part on the upper surface of a base board 11 made of a ceramic dielectric material. Another grounding electrode 14 is formed on the base board 11 towards the back. Although not visible in FIG. 9, still another grounding film electrode is formed on the lower surface of the base board 11 in electrically conductive relationship with the aforementioned ground electrodes 14 on the upper surface of the base board 11. Input/output terminals 12 and 13 are formed as film electrodes on both upper and lower surfaces of the base board 11 at its mutually opposite side parts. The parts of each of these input/output terminals 12 and 13 on the upper and lower surfaces are in electrically conductive relationship through conductive films over the side surfaces of the base board 11.

There is what will be referred to as a coupling board 21 made of a dielectric material, connecting the upper surfaces of the two input/output terminals 12 and 13. Capacitor-forming silver film electrodes 22–24 are formed on the upper surface of this coupling board 21, and another set of two capacitor-forming silver film electrodes 25 and 26 is formed at both ends on its lower surface, being connected by soldering to the input/output terminals 12 and 13 on the base board 11. The connectors 7 from the dielectric coaxial resonators 2–4 are connected, for example, by soldering to the capacitor-forming film electrodes 22–24 on the upper surface of the coupling board 21. It is to be understood that the film electrodes 25 and 26 are drawn in FIG. 9 to be thicker than realistic in order to show their existence and positions clearly.

As shown by the equivalent circuit diagram of FIG. 10, the dielectric resonator apparatus shown in FIG. 9 functions as a three-stage bandpass filter. A capacitor with capacitance $C_1$ is formed on the side of the input/output terminal 12 between the film electrode 22 on the upper surface of the coupling board 21 and the film electrode 25 on the lower surface. Another capacitor with capacitance $C_1$ is formed on the side of the input/output terminal 13 between the film electrode 24 on the upper surface of the coupling board 21 and the film electrode 26 on the lower surface. A left-hand side (as viewed in FIGS. 9 and 10) capacitor with capacitance $C_2$ is formed between the film electrodes 22 and 23 and a right-hand side capacitor also with capacitance $C_2$ is formed between the film electrodes 23 and 24 on the upper surface of the coupling board 21.

With reference next to FIGS. 11A and lib showing the structure of the aforementioned coupling board 21, it is to be noted that the capacitance $C_2$ becomes large if the dimension a (or its width) is increased or the separations b between the film electrodes 22 and 23 and also between the film electrodes 23 and 24 are reduced. There are situations, however, wherein the dimensions of the coupling board 21 or the separations b cannot be changed freely although it may be desired to increase the value of the coupling capacitance $C_2$. In other words, desired filter characteristics may not be obtainable in such situations.

SUMMARY OF THE INVENTION

It is therefore an object of this invention to provide a dielectric resonator apparatus of which the dimension of the coupling board need not be increased in order to obtain a large coupling capacitance value.

A dielectric resonator apparatus embodying the invention, with which the above and other objects can be accomplished, may be characterized as comprising not only a main resonator part with a plurality of resonance circuits (or "resonators" in an equivalent circuit diagram) and a coupling board for capacitively coupling these resonance circuits of the main resonator part, but also a dielectric board superposed on the coupling board for increasing the aforementioned coupling capacitance between the resonance circuits. The main resonator part may be either in the form of a dielectric coaxial resonator with a multi-stage resonance circuit (for example, with a single dielectric block having a plurality of throughholes therethrough, each functioning as an individual resonance circuit or a "resonator") or a plurality of dielectric coaxial resonators each provided with a single-stage resonance circuit or "resonator").

With a dielectric resonator apparatus thus structured with a dielectric board placed on the coupling board, the coupling capacitance between the resonance circuits (or "resonators") can be increased by means of floating capacitance through the dielectric board connected in parallel between the resonator circuits or the series connection of the dielectric board between the resonator circuits. In other words, the coupling capacitance between the resonator circuits can be increased according to this invention without increasing any dimension of the coupling board itself. Another advantage of the present invention is that the coupling capacitance can be adjusted by varying dimensions of the dielectric board. Thus, desired characteristics can be obtained easily without increasing any dimension of the coupling board.

It is to be noted that large capacitance values can be obtained by the use of such a dielectric board even if the width a of the coupling board is not changed. Moreover, the width a of the coupling board can be even reduced if such a dielectric board is used.

BRIEF DESCRIPTION OF THE DRAWINGS

The accompanying drawings, which are incorporated in and form a part of this specification, illustrate embodiments of the invention and, together with the description, serve to explain the principles of the invention. In the drawings:

FIG. 10 is an equivalent circuit diagram of the bandpass filter shown in

FIG. 9; and

Throughout herein, corresponding components of apparatus according to different embodiments of the invention are indicated by the same numerals.

DETAILED DESCRIPTION OF THE INVENTION

Figure 1A:
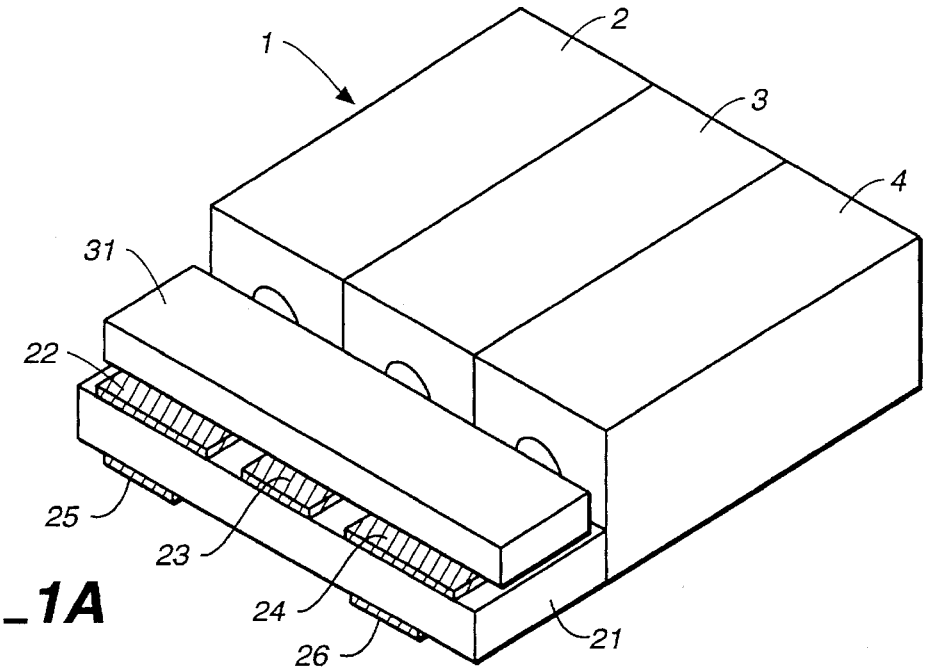
FIGS. 1A and 1B are each a diagonal external view of a portion of a bandpass filter according to a first embodiment of this invention.
Figure 2:
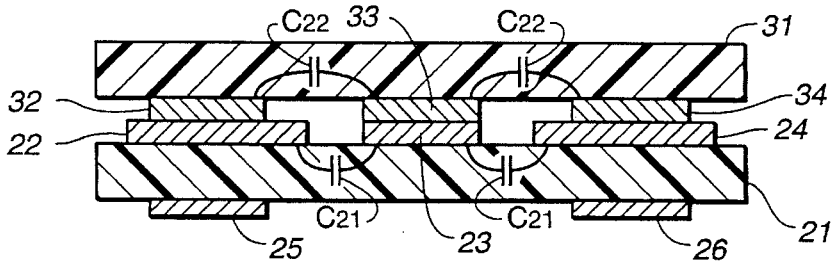
FIG. 2 is a sectional view of a portion of the filter of FIG. 1A or 1B.
Figure 9:
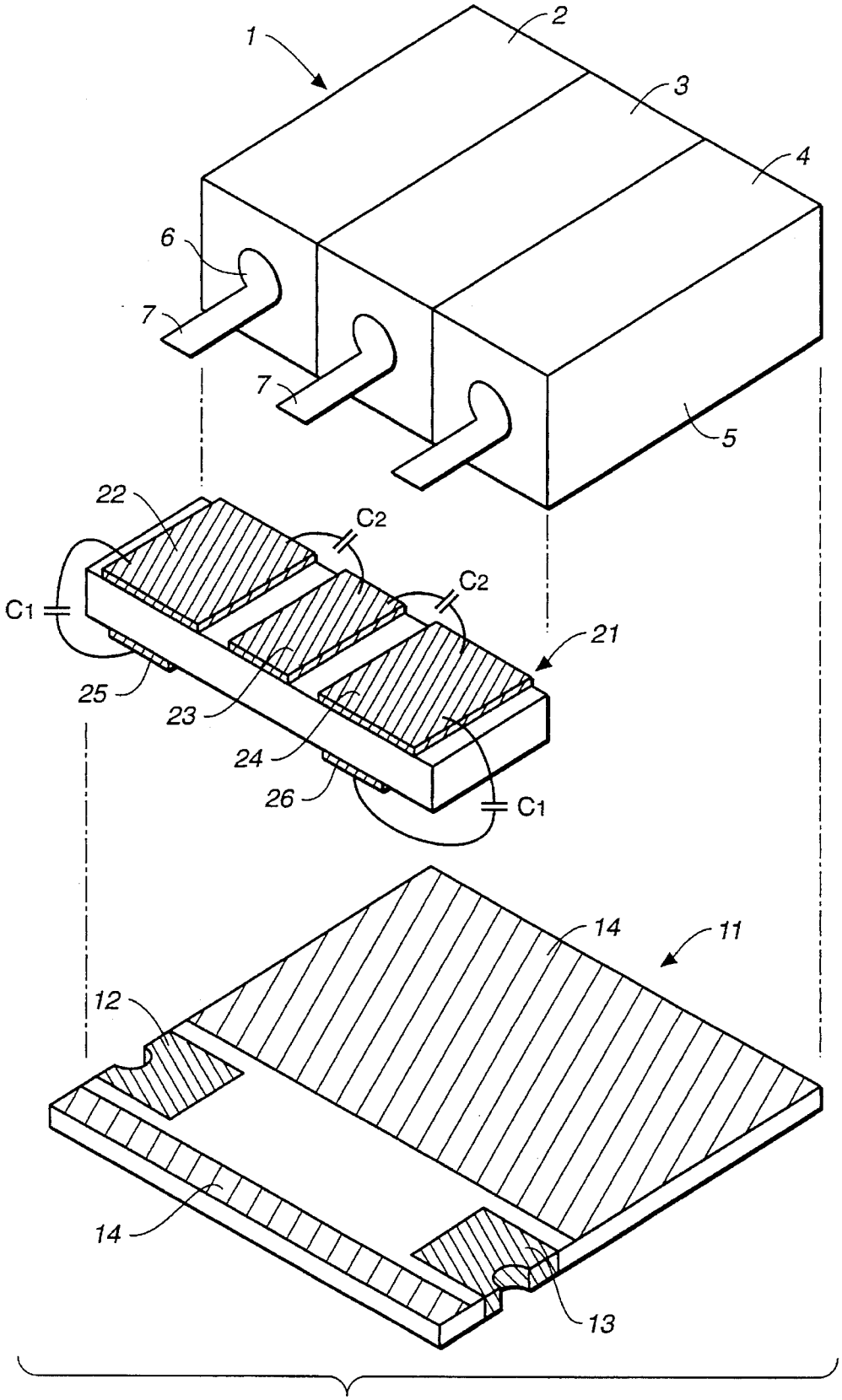
FIG. 9 (PRIOR ART)
FIG. 9 is an exploded view of a prior art bandpass filter.

As shown in FIGS. 1A and 2, a dielectric resonator apparatus according to a first embodiment of this invention is structured similarly to the prior art apparatus described above with reference to FIG. 9 except for a dielectric board 31 superposed on the upper surface of the coupling board 21 in order to increase the coupling capacitance between the dielectric coaxial resonators 2–4. With the apparatus thus structured, the floating capacitance generated between the capacitor-forming film electrodes 22–24 on the coupling board 21 is increased by the presence of the dielectric board 31 so as to have effects on the dielectric coaxial resonators 2–4 or to have increased coupling capacitance.

Figure 10:
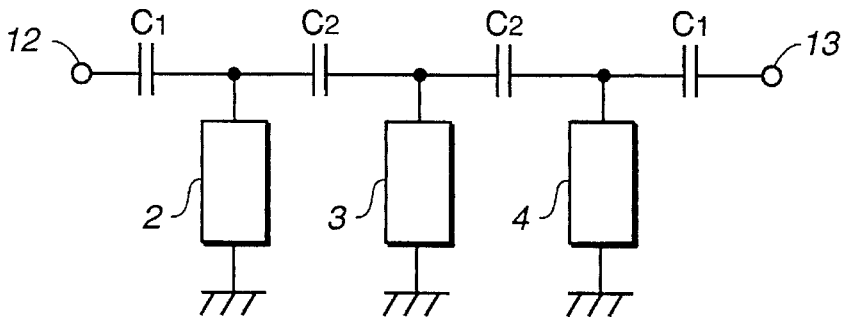
FIG. 10 (PRIOR ART)

FIGS. 1A and 2 show an apparatus functioning as a bandpass filter using three dielectric coaxial resonators 2–4. This embodiment of the invention will be explained next from the point of view of increasing the coupling capacitance $C_2$ between the dielectric coaxial resonators 2–4 shown in FIG. 10.

As shown in FIG. 2, capacitor-forming film electrodes 32–34 are formed on the lower surface of the dielectric board 31 corresponding to the film electrodes 22–24 on the upper surface of the coupling board. When the dielectric board 31 is placed on top of the coupling board 21, the film electrodes 32–34 are made electrically conductive respectively with the film electrodes 22–24, for example, by soldering. This means that additional capacitance $C_{22}$, determined by the dielectric constant, size, thickness, etc. of the dielectric board 31 between the film electrodes 32 and 33 (or 33 and 34), is generated in parallel with the capacitance $C_{21}$ between the film electrodes 22 and 23 (or 23 and 24). In order words, capacitance $C_{22}$ through the dielectric board 31 is connected in parallel to capacitance $C_{21}$ through the coupling board to provide an increase total capacitance $C_2$. Although FIG. 1A shows the dielectric board 31 as being smaller than the coupling board 21, this is not intended to limit the scope of the invention. It goes without saying that their relative size may be varied in order to obtain a desired level of coupling capacitance.

Although the invention has been described above as applied to a bandpass filter, it can be applied in many other situations for increasing the coupling capacitance when high-pass filters, low-pass filters, band elimination filters and other types of filters are combined together. It is also to be understood, although not specifically shown in FIG. 1A, that there may be a circuit board on which the dielectric coaxial resonators 2–4 or the coupling board 21 is to be attached.

Figure 3:
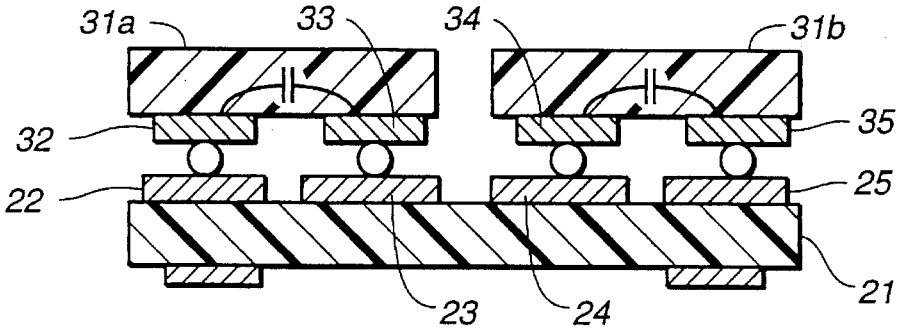
FIG. 3 is a sectional view of a portion of another bandpass filter according to a second embodiment of this invention.

FIG. 3 shows another apparatus according to a second embodiment of the invention, characterized as having two dielectric boards 31*a* and 31*b*. In FIG. 3, as well as in other figures, small circles indicate the positions of the metallic connectors (like those shown at 7 in FIG. 9). The embodiment shown in FIG. 3, as an example, has four dielectric coaxial resonators, having four capacitor-forming film electrodes 22–25 formed on the upper surface of the coupling board 21 and four corresponding film electrodes 32–35 formed on the two dielectric boards 31*a* and 31*b*. The film electrodes 22 and 23 on the coupling board 21 are connected, for example, by soldering with film electrodes 32 and 33, respectively, such that the floating capacitance between film electrodes 32 and 33 through the dielectric board 31*a* is connected in parallel with the capacitance between the film electrodes 22 and 23. Similarly, the capacitance generated between the film electrodes 34 and 35 on the dielectric board 31*b* is connected in parallel with the capacitance between the film electrodes 24 and 25.

Figure 4:
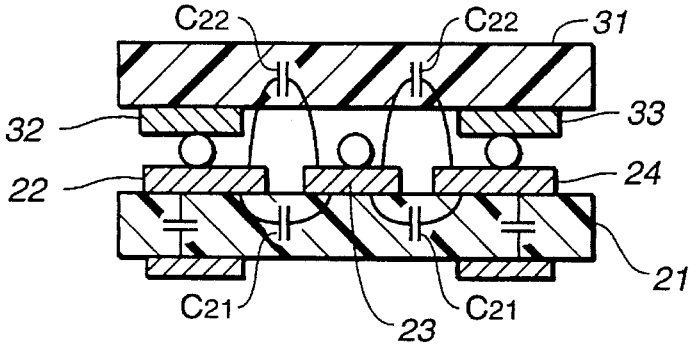
FIG. 4 is a sectional view of a portion of still another bandpass filter according to a third embodiment of this invention.

FIG. 4 shows still another apparatus according to a third embodiment of the invention, using three dielectric coaxial resonators. Film electrodes 32 and 33 are formed at both ends on the lower surface of a dielectric board 31 to be soldered film electrodes 22 and 24 on the coupling board 21, the dielectric board 31 being superposed on the upper surface of the coupling board 21. With an apparatus thus structured, extra capacitance $C_{22}$ due to the presence of the dielectric board 31 is added in parallel to the capacitance $C_{21}$ formed between film electrodes 22 and 23 on the coupling board 21, providing an increased total capacitance $C_2$. Similarly, capacitance $C_{22}$ due to the presence of the dielectric board 31 is added in parallel to the capacitance $C_{21}$ formed between film electrodes 23 and 24 on the coupling board 21, resulting in an increased total capacitance $C_2$. This is to be compared to the situation depicted in FIG. 10.

Figure 5:
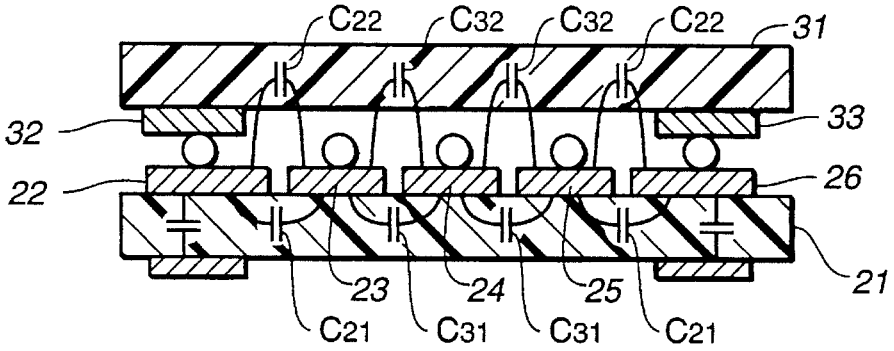
FIG. 5 is a sectional view of a portion of still another bandpass filter according to a fourth embodiment of this invention.

FIG. 5 shows still another apparatus according to a four embodiment of the invention, characterized as using five dielectric coaxial resonators, although it is fundamentally the same as the third embodiment described above, Film electrodes 32 and 33 are formed at both ends on the lower surface of the dielectric board 31 for connection by soldering with film electrodes 22 and 26 on the coupling board 21. Let $C_{21}$, $C_{31}$, $C_{31}$ and $C_{21}$ respectively be the capacitance formed between the film electrodes 22–26 on the coupling board 21, as shown in FIG. 5. Because of the presence of the dielectric board 31 on the upper surface of the coupling board 21, however, floating capacitance $C_{22}$, $C_{32}$, $C_{32}$ and $C_{22}$ between the film electrodes 22–26 on the coupling board 21 are respectively connected in parallel, thereby increasing the coupling capacitance between the film electrodes 22–26.

Figure 6:
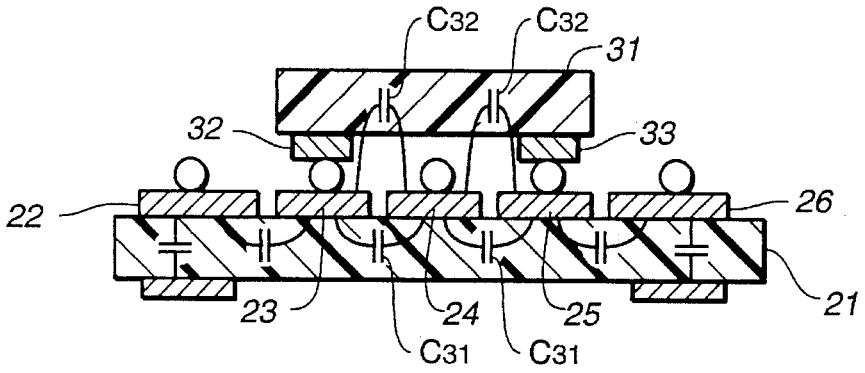
FIG. 6 is a sectional view of a portion of still another bandpass filter according to a fifth embodiment of this invention.

FIG. 6 shows still another apparatus according to a fifth embodiment of the invention, adapted to increase the capacitance $C_{31}$ between film electrodes 23 and 24 and between film electrodes 24 and 25 on the coupling board 21. For this purpose, film electrodes 32 and 33 are formed at both ends on the lower surface of the dielectric board 31 and soldered onto the film electrodes 23 and 25 on the coupling board 21. According to this embodiment, too, floating capacitance $C_{32}$ is obtained due to the presence of the dielectric board 31, and it is connected in parallel with the capacitance $C_{31}$ so as to increase the coupling capacitance.

Figure 7:
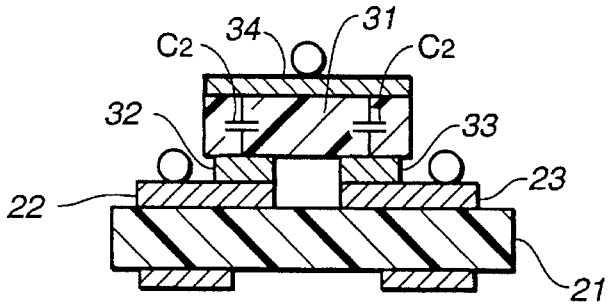
FIG. 7 is a sectional view of a portion of still another bandpass filter according to a sixth embodiment of this invention.

FIG. 7 shows still another apparatus according to a sixth embodiment of the invention, characterized as using three dielectric coaxial resonators and a dielectric board 31 for providing capacitive coupling between the center one and the side ones of the dielectric coaxial resonators. For this purpose, film electrodes 32 and 33 are provided at both ends on the lower surface of the dielectric board 31 and soldered onto film electrodes 22 and 23 on the coupling board 21, and coupling capacitance is obtained by the capacitance $C_2$ between them and a film electrode 34 formed on the upper surface of the dielectric board 31. According to this embodiment, the capacitance $C_2$ can be increased more easily than in the case of FIG. 6 because the capacitance $C_2$ depends on the area. In other words, coupling capacitance between dielectric coaxial resonators can be increased easily by establishing capacitance vertically than horizontally.

Figure 8:
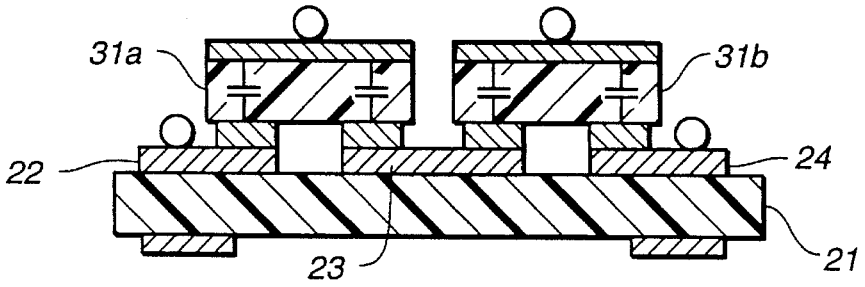
FIG. 8 is a sectional view of a portion of still another bandpass filter according to a seventh embodiment of this invention.

FIG. 8 shows still another apparatus according to a seventh embodiment of the invention which is an extension of the embodiment explained above with reference to FIG. 7. In other words, this embodiment is of a five-stage resonator structure while FIG. 7 shows as three-stage resonator structure. As shown in FIG. 8, two dielectric boards 31*a* and 31*b* are superposed on three film electrodes 22–24 on the coupling board 21. Its operation is similar to FIG. 7 and hence will not be explained separately.

Figure 1B:
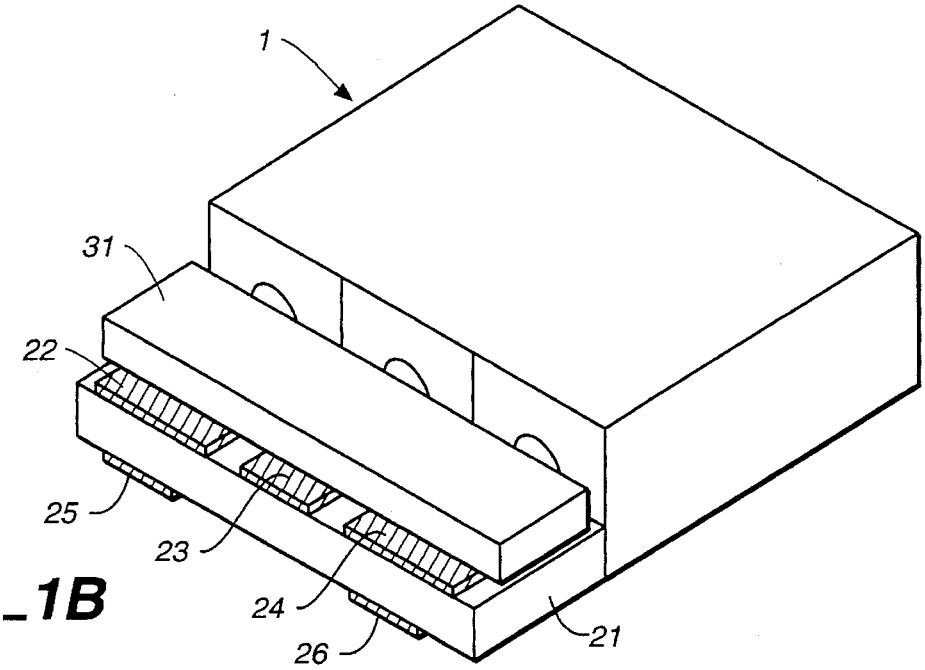

Although FIG. 1A showed an example of this invention wherein a plurality of single-stage dielectric coaxial resonators are used to form what was referred to as a main resonator part to which a coupling board is attached to provide coupling, it should be clear to a person skilled in the art that the basic idea of this invention can be applied also to main resonator parts of a kind formed with a multi-stage dielectric filter. FIG. 1B shows an example of such a dielectric resonator apparatus having its main resonator part 1 structured in the form of a single dielectric block having a plurality (three in this example) of capacitor-forming throughholes. It is also to be recognized that these capacitor-forming holes need not be throughholes. In other words, this invention also applies to dielectric coaxial resonators having a main resonator part of which the shorted surface is closed.

Figure 11A:
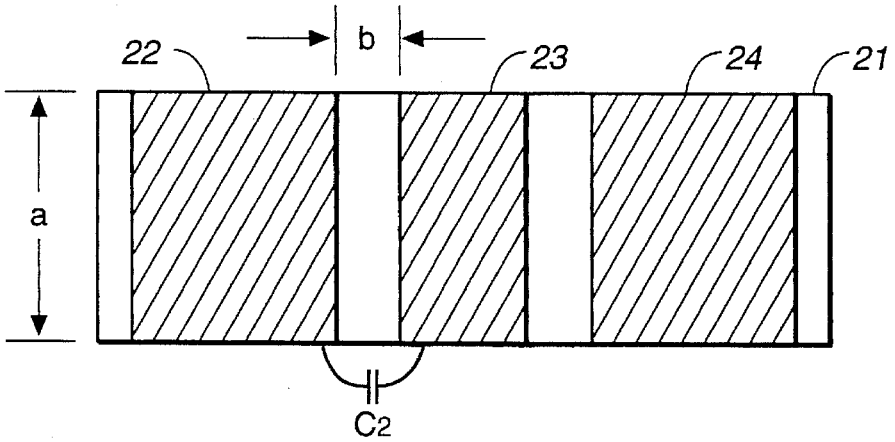
FIG. 11A (PRIOR ART)
FIGS. 11A and 11B are respectively a plan view and a frontal sectional view of the prior art coupling board shown in FIG. 9.
Figure 11B:
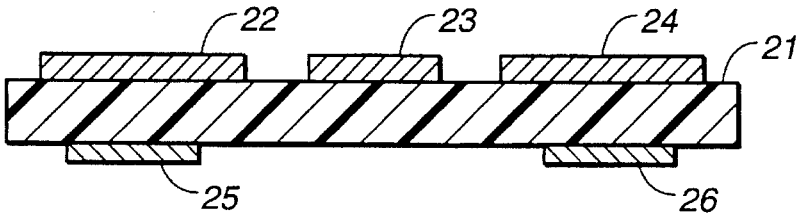
FIG. 11B (PRIOR ART)

In summary, a dielectric board is superposed on the coupling board according to the present invention such that floating capacitance through the dielectric board is connected in parallel between the resonance circuits, or the dielectric board connects them in series. As a result, the coupling capacitance between the resonance circuits can be increased without, for example, making the coupling board inconveniently large. In other words, this invention makes it possible to increase the coupling capacitance between the resonance circuits of many kinds of dielectric resonator apparatus without increasing the dimensions of the coupling board itself. Since the dimensions of the dielectric board can be varied so as to increase the coupling capacitance, desired characteristics can be obtained more easily according to the present invention. In particular, even if the width (indicated by letter a in FIG. 11A) of the coupling board is unchanged, a larger capacitance can be obtained by superposing a dielectric board thereupon, and the use of the dielectric board also makes it possible to reduce the width a of the coupling board.

What is claimed is:

1. A dielectric resonator apparatus comprising:

a main resonator part containing a plurality of resonance circuits and having a plurality of metallic connectors protruding horizontally outward therefrom;

a coupling board having a horizontal upper surface and a plurality of mutually separated upper-surface electrodes formed on said upper surface, at least some of said metallic connectors being directly on and in contact with mutually different ones of said upper-surface electrodes; and one or more dielectric boards, each having a horizontal lower surface and a plurality of mutually separated lower-surface electrodes which are formed on said lower surface and are each directly on and in contact with mutually different ones of said upper-surface electrodes.

2. The dielectric resonator apparatus of claim 1 wherein said main resonator part comprises a plurality of single-stage resonance circuits.

3. The dielectric resonator apparatus of claim 1 wherein said main resonator part comprises a multi-stage dielectric coaxial resonator.

4. The dielectric resonator apparatus of claim 1 wherein said dielectric board serves to increase said capacitive coupling by generating floating capacitance therethrough.

5. The dielectric resonator apparatus of claim 1 wherein said upper-surface electrodes are arranged sequentially on said upper surface.

6. A dielectric resonator apparatus comprising:

a main resonator part containing a plurality of resonance circuits and having a plurality of metallic connectors protruding horizontally outward therefrom;

a coupling board having a horizontal upper surface and a plurality of mutually separated upper-surface electrodes formed on said upper surface, some of said metallic connectors being directly on and in contact with mutually different ones of said upper-surface electrodes; and one or more dielectric boards, each having a horizontal lower surface and a plurality of mutually separated lower-surface electrodes which are formed on said lower surface and are each directly on and in contact with mutually different ones of said upper-surface electrodes, each of said dielectric boards having a top surface opposite said lower surface and a top-surface electrode which is formed on said top surface, each of the others of said metallic connectors being directly on and in contact with different ones of said top-surface electrodes.

7. The dielectric resonator apparatus of claim 6 wherein said upper-surface electrodes are arranged sequentially on said upper surface.

8. The dielectric resonator apparatus of claim 6 wherein each of said lower-surface electrodes provides capacitance with corresponding one of said top electrodes.

9. The dielectric resonator apparatus of claim 6 wherein said main resonator part comprises a plurality of single-stage resonance circuits.

10. The dielectric resonator apparatus of claim 6 wherein said main resonator part comprises a multi-stage dielectric coaxial resonator.

11. The dielectric resonator apparatus of claim 6 wherein at least one of said upper-surface electrodes has one of said metallic connectors thereon and in contact therewith between two of said lower-surface electrodes which are on and in contact with said one upper-surface electrode.

12. The dielectric resonator apparatus of claim 11 wherein at least one of said upper-surface electrodes has one of said metallic connectors thereon and in contact therewith between two of said lower-surface electrodes which are on and in contact with said one upper-surface electrode.

13. A dielectric resonator apparatus comprising:

a main resonator part containing a plurality of resonance circuits and having a plurality of metallic connectors protruding horizontally outward therefrom;

a coupling board having a horizontal upper surface and a plurality of mutually separated upper-surface electrodes formed on said upper surface, said metallic connectors being directly on and in contact with mutually different ones of said upper-surface electrodes; and one or more dielectric boards, each having a horizontal lower surface and a plurality of mutually separated lower-surface electrodes formed on said lower surface, said lower-surface electrodes being directly on and in contact with mutually different ones of said upper-surface electrodes.

14. The dielectric resonator apparatus of claim 13 wherein said main resonator part comprises a plurality of single-stage resonance circuits.

15. The dielectric resonator apparatus of claim 13 wherein said main resonator part comprises a multi-stage dielectric coaxial resonator.

16. The dielectric resonator apparatus of claim 13 wherein each of said dielectric boards has a top surface opposite said lower surface and a top-surface electrode which is formed on said top surface and lies underneath and in contact with corresponding one of said metallic connectors.

17. The dielectric resonator apparatus of claim 13 wherein said upper-surface electrodes are arranged sequentially on said upper surface.

18. The dielectric resonator apparatus of claim 13 wherein said dielectric board serves to increase said capacitive coupling by generating floating capacitance therethrough.

19. The dielectric resonator apparatus of claim 18 wherein each of said lower-surface electrodes provides capacitance with corresponding one of said top electrodes.

* * * * *